United States Patent [19]

von Knorring

[11] 4,347,886

[45] Sep. 7, 1982

[54] ROLLER BLINDS

[76] Inventor: Enar S. von Knorring, 77020 Saderbarke, Sweden

[21] Appl. No.: 154,702

[22] Filed: May 30, 1980

[51] Int. Cl.[3] ..... E06B 9/20; A47H 1/00

[52] U.S. Cl. ..... 160/242; 160/310

[58] Field of Search ..... 160/242, 243, 310, 311, 160/309, 323–326, 66–68

[56] References Cited

U.S. PATENT DOCUMENTS 1,595,234 8/1926 Kuyper ..... 160/242 X 4,060,310 11/1977 Brown ..... 160/310 X

FOREIGN PATENT DOCUMENTS 65054 7/1942 Norway ..... 160/242

*Primary Examiner*—Philip C. Kannan

*Attorney, Agent, or Firm*—William A. Drucker

[57] ABSTRACT

A roller blind has a roller with axially projecting trunnions each of which engages in an elongated arcuate slot in a respective end bracket mounting the blind on a supporting structure such as window frame. One trunnion is connected to a reversible motor for winding up and lowering the blind. The trunnions each bear frictionally on an edge bounding the slot, and the blind is wound on the roller such that rotation of the roller in the direction to lower the blind causes movement, by frictional engagement, of the trunnions along the slots to bring the blind closer to the window frame, whereas winding up of the blind moves it farther away from the window frame.

2 Claims, 4 Drawing Figures

ROLLER BLINDS

CROSS REFERENCE TO PRIOR APPLICATION

This application is related to my copending application, Ser. No. 31,088, filed Apr. 18, 1979, now U.S. Pat. No. 4,262,729, which was a continuation-in-part of Ser. No. 858,212, filed Dec. 7, 1977, now abandoned.

BACKGROUND OF THE INVENTION

This invention relates to a roller blind which has axially projecting trunnions guided in slots in brackets to enable said roller to be rotated and also to be displaced towards and away from a window upon rotation of said roller, thereby enabling the screen to be located as close to the window as possible when the screen is in its unrolled position of use.

The object of the invention is to provide a simple and reliable motor drive means for said roller. Further objects will be apparent from the following description, the drawing and the claims.

BRIEF DESCRIPTION OF THE DRAWING

The drawing illustrates a preferred embodiment of the invention.

In the drawing.

DESCRIPTION OF THE PREFERRED EMBODIMENT

Recently roller blinds having sound and/or heat insulation have been developed. Such screens are relatively heavy however, and it is cumbersome to operate such screens manually. In the roller blind illustrated, use is made of an electric motor to lift and lower the blind.

Figure 1:
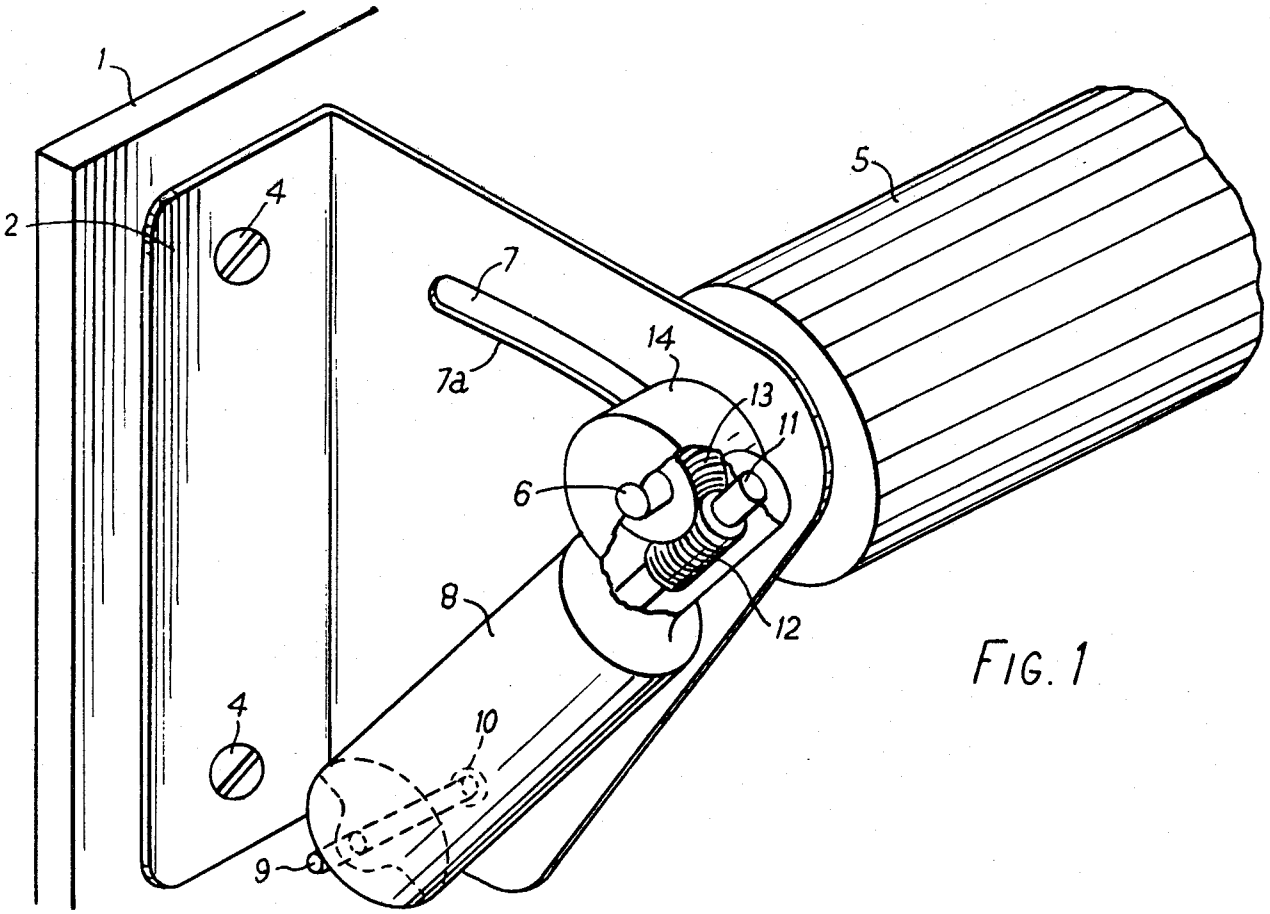
FIG. 1 is a perspective view of one end of a motorised roller blind, seen in its position spaced widely from the window frame.
Figure 3:
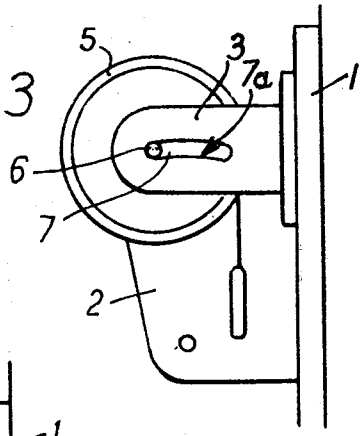
FIG. 3 is an end elevation, on a smaller scale, of the window blind seen in its position of FIG. 1 and viewed from the other end.
Figure 4:
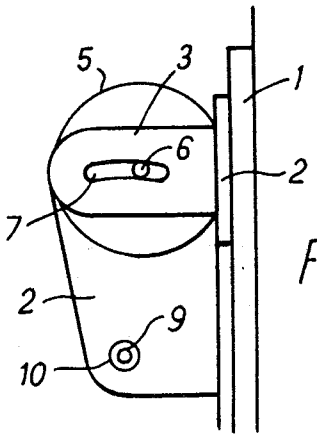
FIG. 4 is an end elevation, on a smaller scale, of the window blind seen in its position of FIG. 2 and viewed from the other end.
Figure 2:
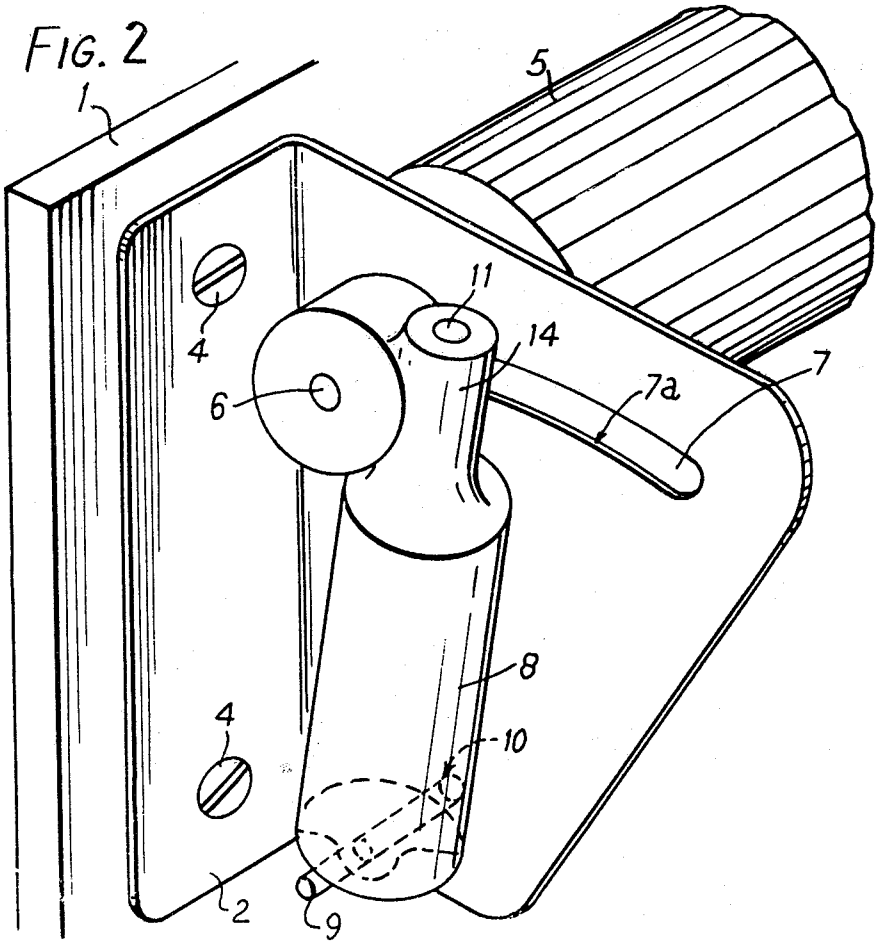
FIG. 2 is a corresponding perspective view showing the roller blind in its position closer to the window frame.

The roller blind is mounted on a window frame 1 by brackets 2 and 3 disposed one at each end of the blind and secured by screws 4. The blind 5 is rolled on a shaft 6 which extends from the blind at each end to form a respective trunnion which is engaged through an elongated arcuate slot 7 formed in the projecting arm of the brackets 2 and 3. The trunnions formed by the two ends of the shaft 6 carry the weight of the blind and each rests on a lower edge *7a* bounding the slot 7. When the shaft 6 is rotated in the direction to roll down the blind, the frictional engagement between the trunnions and the respective lower edge *7a* causes the trunnion to roll along the slot 7 in the direction to bring the entire blind closer to the window frame 1. Thus, when the blind is fully unwound, it is in the position shown in FIGS. 2 and 4. When the shaft 6 is rotated in the reverse direction, to raise the blind, the frictional engagement between the shaft-end trunnions and the respective edge *7a* causes the shaft to move outwardly away from the window frame as seen in FIGS. 1 and 3.

To rotate the shaft 6 there is provided an electric motor which is mounted by means of a pivot shaft 9, parallel to the axis of the shaft 6, engaged with clearance in a hole 10 of the bracket 2. The axis of the pivot shaft 9 is concentric with the axis of the arcuate slot 7. There is sufficient play between the pivot shaft 9 and the hole 10 to permit the trunnions to rest by their own weight, and the weight of the blind, on the edge surface *7a*. The drive shaft 11 of the motor carries a worm 12 which is meshed with a worm wheel 13 keyed on the shaft 6. The worm and worm wheel are housed in a common housing 14 secured on the body of the motor, and seen partly broken away in FIG. 1.

Any convenient known switching means 9 (not shown) are provided for energising the motor from a source of supply of current, with the possibility of reversing the direction of rotation of the motor.

I claim:

1. A roller blind comprising:

(i) a pair of brackets, for mounting on a support structure each bracket including an arm with an elongated slot therein, the brackets each being such that when they are mounted on the supporting structure the slot extends in the direction away from the support structure, (ii) a roller, to receive a screen, having a respective trunnion extending axially from each end of the roller, each said trunnion being engaged through the slot of a respective one of the brackets and bearing frictionally on an edge bounding the slot, (iii) a screen having an end thereof secured to said roller, (iv) reversing motor drive means connected to one of said brackets and to the roller for rotating said roller, the screen being wound onto the roller in the direction such that rotating of the roller in the direction to lower the screen causes travel of the trunnions along the respective slot to bring the screen nearer to the support structure, and rotation of the roller in the direction to raise the screen causes travel of the trunnions along the respective slot to move the screen farther away from the support structure, wherein the reversing motor drive means comprises an electric motor mounted by a pivot on said one bracket and having a drive shaft drivingly connected to the adjacent trunnion, said slot being arcuate and the axis of said pivot being concentric with the axis of said arcuate slot, said pivot providing clearance such that the respective trunnion rests by its own weight, and the weight of the roller and blind, on said edge bounding the slot.

2. A roller blind, as claimed in claim 1, wherein said motor drive shaft carries a worm which is meshed with a worm wheel secured on the trunnion.

* * * * *